United States Patent [19]

Adachi

[11] Patent Number: 4,530,594

[45] Date of Patent: Jul. 23, 1985

[54] CLEANING DEVICE

[75] Inventor: Hiroyuki Adachi, Hachioji, Japan

[73] Assignee: Canon Kabushiki Kaisha, Tokyo, Japan

[21] Appl. No.: 494,525

[22] Filed: May 13, 1983

[30] Foreign Application Priority Data

May 21, 1982 [JP] Japan ..... 57-86327
Jul. 13, 1982 [JP] Japan ..... 57-121823

[51] Int. Cl.[3] ..... G03G 15/08

[52] U.S. Cl. ..... 355/15; 15/256.5; 118/652; 430/125

[58] Field of Search ..... 355/15, 3 DD, 14 D; 15/256.51, 256.52, 256.5; 118/652; 430/125

[56] References Cited

U.S. PATENT DOCUMENTS 3,838,472 10/1974 Oriel .
4,357,098 11/1982 Endo ..... 355/15
4,401,385 8/1983 Katayama et al. ..... 355/15
4,412,736 11/1983 Sakamoto et al. ..... 355/15

*Primary Examiner*—A. C. Prescott
*Attorney, Agent, or Firm*—Fitzpatrick, Cella, Harper & Scinto

[57] ABSTRACT

A cleaning device for removing the substance deposited on a surface to be cleaned with a cleaning member maintained in contact with the surface and recovering the removed developer into a container, which is provided with a member for limiting the free movement of the developer in the container.

10 Claims, 12 Drawing Figures

CLEANING DEVICE

BACKGROUND OF THE INVENTION

1. Field of the Invention

The present invention relates to a cleaning device for use in an image forming apparatus such as electrophotographic copier, a microfilm apparatus, a printer or a recording apparatus, and more particularly to such cleaning device for removing the substance deposited on a surface to be cleaned by means of a cleaning member maintained in contact with said surface and recovering thus removed developer into a container.

2. Description of the Prior Art

In the following description an electrophotographic copier will be adopted as an example.

In the field of image forming apparatus in which a developed image is formed on an image bearing member such as an electrophotographic photosensitive member and is subsequently utilized for transfer, there are already proposed various cleaning devices for removing the developer remaining on said image bearing member.

The cleaning member for such cleaning device is for example of an elastic blade or a brush, and the developer removed with such cleaning member is generally recovered in a recovery container through an aperture formed adjacent to said cleaning member.

The developer recovered in said recovery container is either stored therein until the maintenance service or supplied for example by a screw conveyor to a container for used developer provided outside the cleaning device or to a developing device for the purpose of re-use. In either case a considerable amount of removed developer remains in the recovery container after the cleaning operation. Consequently the developer may be scattered through the aperture of the cleaning device in case it is detached from the image forming apparatus and is held in inclined position at the maintenance service. More specifically, a conventional cleaning device shown in lateral cross-sectional view in FIG. 1 is generally mounted in horizontal position as shown in a front view in FIG. 2A. The cleaning device 1 is provided, at the front face of a housing 2 thereof, with an aperture 0, above which is provided a cleaning member composed of an elastic blade 3. Also below said aperture 0 there is provided a guide member 4 for guiding the removed developer into the housing. Consequently the front aperture 0 of the housing is formed as a slit defined at the upper and lower end thereof respectively by the lower rim of the cleaning member 3 and the upper rim of the guide member 4.

A photosensitive drum 6 is rotated in a direction indicated by arrow by means of unrepresented driving means, and is provided, along the periphery thereof, with not-shown latent image forming means and image developing means to form a developed image on said photosensitive drum. The developed image thus formed is transferred, by a transfer corona charger 7, onto a transfer sheet 8, and the developer 9 remaining on the photosensitive drum 6 is removed by the cleaning member 3 of the cleaning device 1 and is guided, through said aperture 0, into the housing. In the horizontal state shown in FIG. 2A, there is no danger that the developer 5 contained in the housing will spill out to the outside. However, in case the cleaning device is detached from the image forming apparatus for example in the maintenance service, it may eventually be maintained in an inclined position as shown in FIG. 2B, and, in such case the recovered developer flows in the space of the housing and may be spilt therefrom. Even without such spilling, the developer may remain in the unbalanced state when the cleaning device is returned to the horizontal position, and there may result unsatisfactory recovery of the removed developer through the aperture at a side where the developer is accumulated.

SUMMARY OF THE INVENTION

An object of the present invention is to provide a cleaning device capable of preventing unbalanced accumulation of the developer recovered in the container.

Another object of the present invention is to provide a cleaning device capable of preventing the spilling of the developer recovered in the container.

Still another object of the present invention is to provide a cleaning device capable of satisfactory recovery of the developer removed from the surface to be cleaned.

DESCRIPTION OF THE PREFERRED EMBODIMENTS

The present invention will now be described in detail referring to the embodiments thereof.

Figure 1:
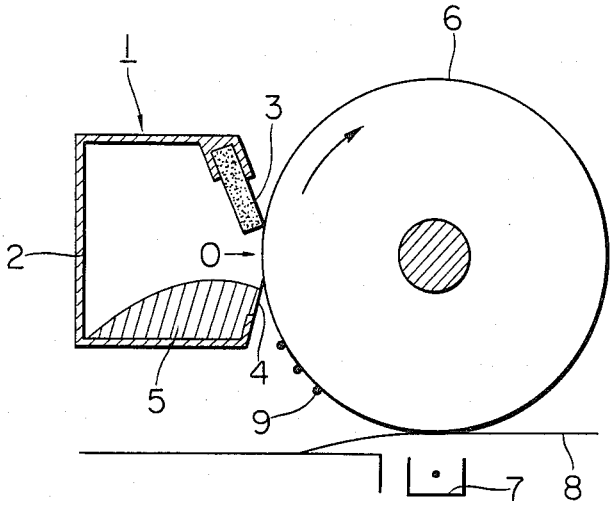
FIG. 1 PRIOR ART
FIG. 1 is a lateral cross-sectional view of a conventional cleaning device.
Figure 2A:
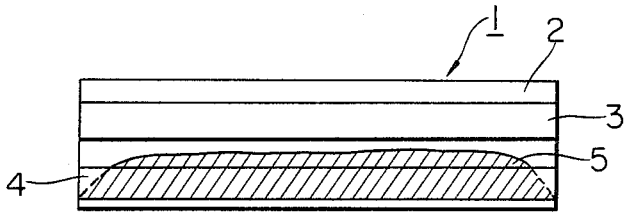
FIG. 2A PRIOR ART
FIGS. 2A and 2B are elevation views of the conventional cleaning device shown in FIG. 1.
Figure 2B:
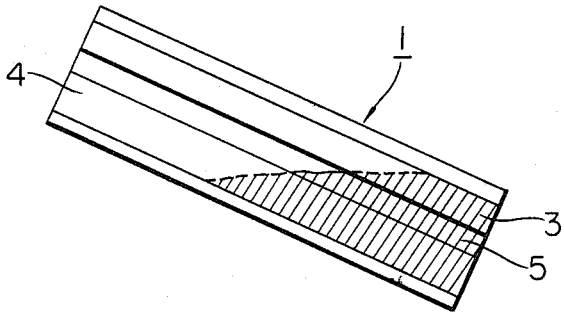
FIG. 2B PRIOR ART
Figure 3:
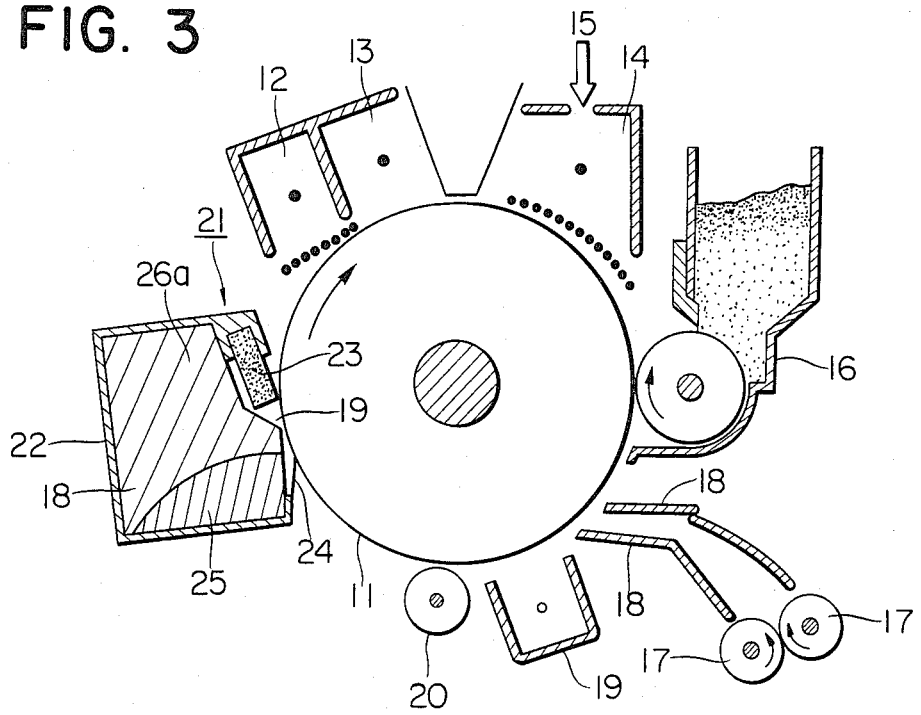
FIG. 3 is a schematic lateral cross-sectional view of a copier provided with a cleaning device embodying the present invention.

FIG. 3 is a schematic lateral view of an image forming apparatus provided with a cleaning device embodying the present invention, wherein a photosensitive drum 11 functioning as the image bearing member is at first subjected to elimination of hysteresis by a corona pre-discharger 12, then uniformly charged by a primary corona discharger 13, and subsequently subjected to secondary discharge by a corona discharger 14 simultaneous with imagewise exposure 15 of an original to form an electrostatic latent image. Said latent image is subsequently developed with magnetic developer or toner in a developing device 16 as a toner image. Said toner image is then transferred onto a transfer sheet supplied through roller 17 and guide member 18, by means of corona discharge of a polarity, opposite to that of said toner, given to the rear face of said transfer sheet by a transfer corona discharger 19. The transfer sheet thus bearing the copied image is separated from the photosensitive drum by separating means such as a separating roller 20, and is transported to a not shown fixing device.

The photosensitive drum 11 is subjected to the removal of remaining toner by a cleaning device 21 embodying the present invention and is repeatedly used in the above-described imaging cycle.

In an embodiment of the cleaning device of the present invention shown in FIGS. 3 and 4, a housing 22 constituting a recovery container 18 for the developer is provided, at the front face thereof, with a recovery aperture 19, which is defined at the upper rim by a cleaning member 23 and at the lower rim by a guide member 24 for the developer. In the present embodiment the cleaning member 23 is composed of a rubber blade of which an edge is maintained in contact with the surface of the photosensitive drum 11.

Figure 4A:
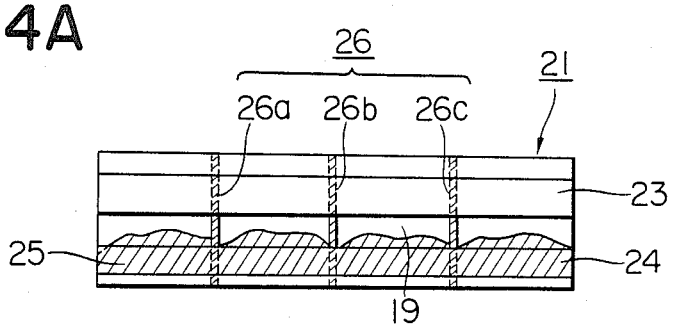
FIGS. 4A and 4B are elevation views of the cleaning device shown in FIG. 3.
Figure 4B:
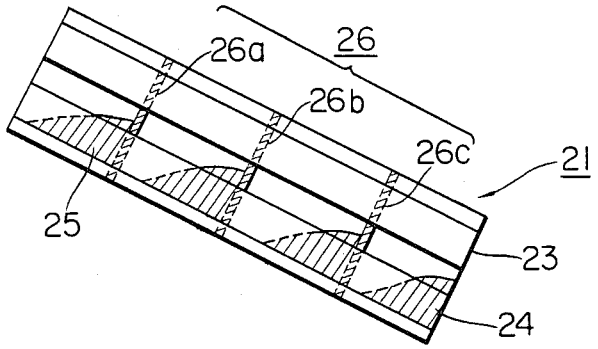

As shown in FIGS. 3 and 4A said housing is provided therein with partition members 26*a*–26*c* of a form similar to the lateral cross-section of said housing, positioned at a regular interval along the direction of the slit aperture 19, or along the contact direction of the cleaning member 23 with the photosensitive member 11. In the present embodiment said partition members 26*a*–26*c* are positioned perpendicular to said contact direction. Said partition members are provided for limiting the free movement of the developer 25. Even in case the cleaning device 21 is inclined as shown in FIG. 4B, the unbalanced heaping of developer is reduced since the developer can only flow in each of the spaces divided by the partition members 26*a*–26*c*. In this manner the developer spilling from the slit aperture 19 can be prevented. Also the unbalanced heaping of the developer can be easily resolved when the cleaning device is returned to the horizontal position, and the recovery function is not hindered even if such unbalanced heaping is not completely resolved since the amount thereof is reduced.

In this manner it is rendered possible to satisfactorily prevent the unbalanced heaping of the developer in the cleaning device at the maintenance service or at the transportation of the image forming apparatus.

Figure 5:
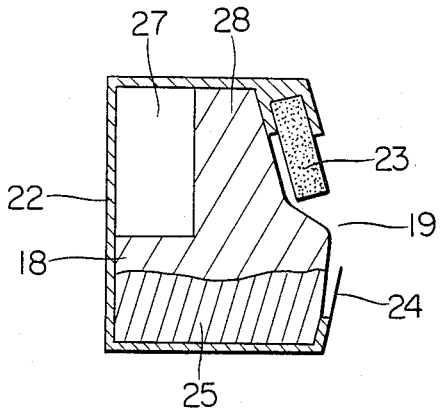
FIG. 5 is a lateral cross-sectional view of a cleaning device representing another embodiment of the present invention.
Figure 6:
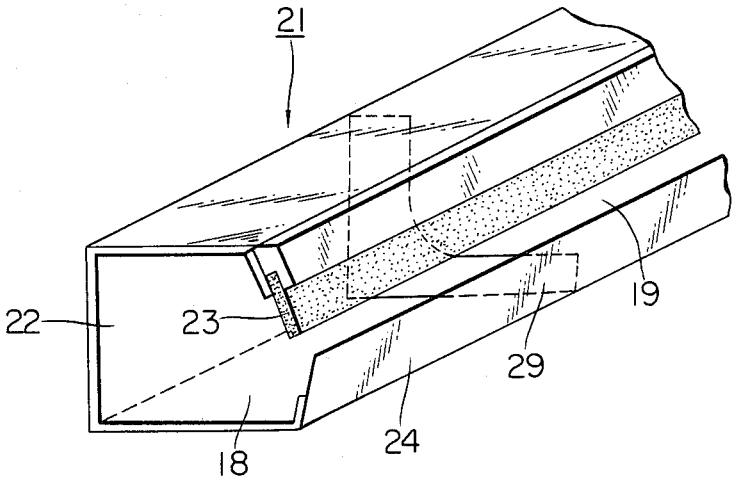
FIG. 6 is a perspective view of a cleaning device representing still another embodiment of the present invention.

Said partition member 26 for limiting the free movement of the developer in the direction of contact of the cleaning member, i.e. the direction of lower rim of the elastic blade shown in FIG. 4A, may be so constructed as to completely divide the cross section of the housing as shown in FIG. 3, or, as shown in FIG. 5, may be constructed as partition members 28 having cut-out portions 27 in the upper rear part of the space in the housing 22. It will be evident that any other form may be adopted as long as it does not cause excessive movement of the developer. As an example, as shown in FIG. 6, there may be employed partition members 29 having curved cut-out portions at the side of the aperture 19. The distances between the partition members may be made constant or varied according to the amount of the developer to be recovered. More specifically said distance is selected smaller in a portion where the amount of the developer to be recovered is smaller, or larger in a portion where the amount of such developer is larger. Local concentration of the recovered developer can be advantageously avoided if the ratio of the volume of the recovered developer to the volume of the container is maintained constant in each divided space.

As explained in the foregoing, the cleaning device of the present embodiment can effectively prevent the scattering of the recovered developer at the movement of the cleaning device in the maintenance service, and can constantly maintain satisfactory cleaning performance since excessive unbalanced heaping caused by the flow of the recovered developer in the cleaning device is limited.

Figure 7:
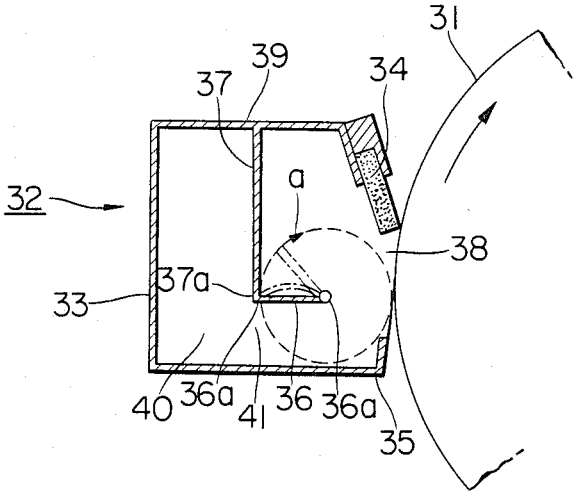
FIG. 7 is a lateral cross-sectional view of a cleaning device representing still another embodiment of the present invention.
Figure 8:
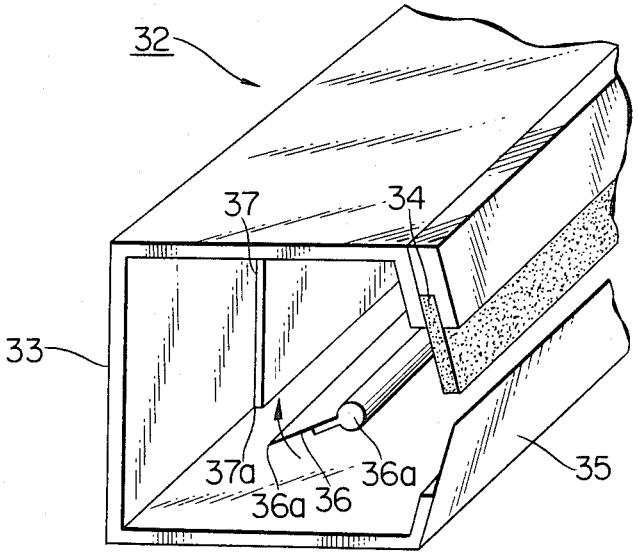
FIG. 8 is a perspective view of the cleaning device shown in FIG. 7.

Now reference is made to FIGS. 7 and 8 showing another embodiment of the present invention respectively in a lateral cross-sectional view and a perspective view, wherein a partition member is provided parallel to an aperture 38, in combination with means for supplying developer in the vicinity of the contact position of the cleaning member with the image bearing member.

In FIGS. 7 and 8, an image bearing member 31 such as a photosensitive drum is rotated in a direction of arrow by not-shown driving means, and is provided, along the trajectory of movement thereof, with not-shown latent image forming means, image developing means, image transfer means etc. for image formation. The developer remaining on the image bearing member is removed by a cleaning device 32 of the present invention, essentially composed of a housing 33 for the recovered developer, having an aperture 38 at a side facing the image bearing member. The upper and lower rims of said aperture 38 are respectively defined by a polyurethane rubber blade 34 and a toner receiving sheet. The width of the aperture 38 of the housing 33 is made substantially equal to that of the image bearing member 31, or at least larger than that of the image forming area on the image bearing member, and the blade 34 and the toner receiving sheet 35 provided at the lower rim of the aperture 38 have lengths enough for covering the width of the image forming area. In the housing 33 there is provided a rotatably supported flexible plate or blade member 36 as means for scattering the developer in the contact area of the blade 34 with the image bearing member. A rotary shaft 36*a* of said plate member 36 is positioned parallel to the aperture 38, and is supported, at both ends thereof, by lateral end plates of the housing. Said shaft 36*a* is driven by not-shown driving means to rotate the flexible plate member 36 in a direction indicated by arrow a. In the moving path of the flexible plate member 36 there protrudes the lower end 37*a* of a partition member 37 fixed to the ceiling 39 of the housing to define a space 40 for storing the developer at the rear side of the housing 33. The plate member 36 deflects at the front end portion 36*a* thereof with the lower end 37*a* at each rotation and is therefore bent, whereby the plate member 36 vibrates and scatters the developer present thereon to the vicinity of the contact area of the blade 34 with the image bearing member. In this manner the developer of an amount enough for lubricating effect is furnished to said contact area of the blade 34.

The flexible plate member 36 can be composed of an elastic material such as rubber or synthetic resin, or a metal plate such as phosphor bronze. It may also be made with a highmolecular film such as polyethylene or a nylon cloth coated with rubber.

The partition member 37 is required to limit the flow of the recovered developer as will be explained later and to have a rigidity enough for bending the plate member 36, and can be made of various metals or a synthetic resin such as acrylic resin.

In the illustrated embodiment, said flexible plate member 36 performs, in the lower half of the circular motion thereof, a function of transporting the developer, removed by the blade 34, into the separated space 40 of the housing 33. The transporting function of said flexible plate member 36 not only performs the transportation but also the compression of the developer, thereby enabling to store the developer at a high density in said separated space 40. In this manner the partition member 37 positioned parallel to the aperture 38 limits the free movement of the developer in the space 40 in a direction perpendicular to the contact direction of the blade member mentioned above.

As an example, the density of the recovered developer, which is generally in a range of 0.5 to 0.6 gr/cm$^3$ in the conventional system, can be raised to a range of 0.75 to 0.8 gr/cm$^3$ in the present embodiment. The lower end 37*a* of the partition member 37 defines the aperture 41 of the separated space 40, and scrapes off, in addition to the developer scattering function explained before, a part of the developer adhering to the plate member 36 during the transporting function, thereby contributing to the transportation of developer into said space 40. The developer once stored in the space 40 is prevented, by the partition member 37, from the movement toward the aperture 38.

Figure 9A:
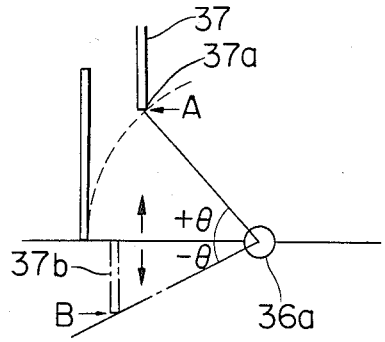
FIG. 9A is an explanatory chart showing the positional relationship between a plate member and a partition member.
Figure 9B:
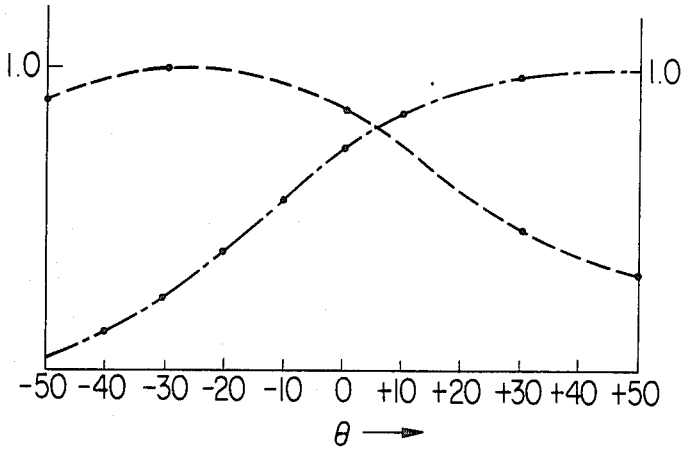
FIG. 9B a chart showing the relationship between the rate of scattering and the rate of transportation of the developer.

FIGS. 9A and 9B show the change in proportions of developer scattering to the contact area and of developer transportation into the separated space according to the positional relationship between the flexible plate member and the lower end of the partition member for causing the vibration in the foregoing embodiment.

FIG. 9A shows the positional relationship between the flexible plate member and the lower end of the partition member, wherein the position of the lower end 37*a* of the partition member 37 is represented by an angle $\theta$, which is considered positive or negative respectively above and below a horizontal plane containing the rotary shaft of the flexible plate member and in a part opposite to the image bearing member across said rotary shaft, so that a position 37*a* above said plane is defined by $+\theta$ while a position 37*b* below said plane is defined by $-\theta$.

In FIG. 9B, the ordinate at right indicates the proportion of developer scattering to the blade contact area while the ordinate at left indicates the proportion of developer transportation into the separated space, both as a function of the position of said vibration inducing part of the partition member indicated in the abscissa.

As will be observed from this chart, the developer scattering and the developer transportation in the present embodiment can be satisfactorily achieved in an angle range $-30° \leqq \theta \leqq 30°$ preferably $0° \leqq \theta \leqq 10°$. Also as will be apparent from FIG. 9B, the developer transportation becomes enhanced at a negative value of the angle $\theta$, while the developer scattering is facilitated at a positive value of the angle $\theta$.

Consequently, instead of utilizing the lower end of the partition member as the vibration inducing part, it is effectively possible to extend the partition member 37 to the negative side and to provide a separate vibration inducing member at the positive side. Such structure can achieve further improved effects since each member can be placed at optimum position for each function.

As explained in the foregoing, the present embodiment is capable of preventing the unbalanced heaping and spilling of the developer since the partition member 37 limits the movement of the developer, transported into the space 40 defined by said partition member 37, toward the aperture 38. Also the present embodiment is provided with means for providing the developer in the vicinity of the contact area of the cleaning member with the image bearing member, thereby achieving uniform and satisfactory cleaning without excessive load on the cleaning device. In addition the cleaning member can be prevented from uneven abrasion resulting from uneven load thereto, whereby the cleaning member can ensure stable function over a prolonged period without frequent replacement.

In the foregoing embodiments a cleaning blade has been adopted as the cleaning member, but the present invention is by no means limited to such cleaning blade but is also applicable to other cleaning members such as cleaning roller or cleaning fur brush.

Also the member to be cleaned is not limited to image bearing members such as a photosensitive drum or an insulating drum but the present invention is applicable to other members such as a fixing roller.

As explained in the foregoing, the present invention provides a cleaning device adapted for limiting the free movement of the recovered developer, thereby preventing the unbalanced heaping or spilling of the developer, or insufficient recovery thereof.

What I claim is:

1. A cleaning device comprising:

a cleaning member in contact with a surface of a member to be cleaned by removing developer thereon;

a recovery container for recovering the developer removed by said cleaning member; and a partition member provided in the recovery container so as to divide the interior of the recovery container into plural recovery spaces and thereby limit the movement of the developer recovered therein.

2. A cleaning device comprising:

a cleaning member in contact with a surface of a member to be cleaned by removing developer thereon;

a recovery container for recovering the developer removed by said cleaning member; and a partition member, having a cut-out portion, provided in the recovery container to divide the interior of the recovery container into plural recovery spaces, and thereby limit the movement of the developer between adjacent spaces.

3. A cleaning device comprising:

a cleaning member in contact with a surface of a member to be cleaned by removing developer thereon;

a recovery container for recovering the developer removed by said cleaning member;

a flexible, rotatable member for conveying the developer removed by said cleaning member and applying a compressing force thereto; and a partition member provided in the recovery container to store the removed developer, said partition member dividing a storing space in said container and extending to a position where a portion of said flexible rotatable member may contact said partition member.

4. A cleaning device according to claim 1, 2, or 3, wherein said cleaning member includes a blade.

5. A cleaning device according to claim 1, 2 or 3, wherein said cleaning member includes a fur brush.

6. A cleaning device according to claim 1, 2 or 3, wherein said cleaning member is a roller.

7. A cleaning device according to claim 1, or 2, wherein said recovery container includes a plurality of equidistantly spaced partition members.

8. A cleaning device according to claim 2, wherein said cut-out portion of said partition member defines a curved surface of said partition member.

9. A cleaning device according to claim 1, 2 or 3, wherein the member to be cleaned is a photosensitive drum.

10. A cleaning device according to claim 1 or 2, wherein said partition member defines a plane substantially perpendicular to the direction of contact of said cleaning member.

* * * * *